US012137791B2

(12) United States Patent
Chevalier

(10) Patent No.: US 12,137,791 B2
(45) Date of Patent: Nov. 12, 2024

(54) REFILLABLE DEVICE FOR PACKAGING A COSMETIC PRODUCT

(71) Applicant: L V M H RECHERCHE, Saint Jean de Braye (FR)

(72) Inventor: Marc Chevalier, Franconville (FR)

(73) Assignee: L V M H RECHERCHE, Saint Jean de Braye (FR)

( * ) Notice: Subject to any disclaimer, the term of this patent is extended or adjusted under 35 U.S.C. 154(b) by 302 days.

(21) Appl. No.: 16/649,946

(22) PCT Filed: Sep. 25, 2018

(86) PCT No.: PCT/FR2018/052362
§ 371 (c)(1),
(2) Date: Mar. 23, 2020

(87) PCT Pub. No.: WO2019/058087
PCT Pub. Date: Mar. 28, 2019

(65) Prior Publication Data

US 2020/0275759 A1 Sep. 3, 2020

(30) Foreign Application Priority Data

Sep. 25, 2017 (FR) ..... 17 58857

(51) Int. Cl.
*A45D 40/00* (2006.01)
*A45D 33/00* (2006.01)
*A45D 34/00* (2006.01)

(52) U.S. Cl.
CPC ..... *A45D 40/0068* (2013.01); *A45D 33/003* (2013.01); *A45D 34/00* (2013.01)

(58) Field of Classification Search
CPC .. A45D 40/0068; A45D 33/003; A45D 34/00; B65D 77/048; B65D 77/0486; B65D 77/0493
See application file for complete search history.

(56) References Cited

U.S. PATENT DOCUMENTS 5,388,298 A * 2/1995 Rutter ..... D06F 39/024 68/17 R
5,938,016 A 8/1999 Erdtmann
(Continued)

FOREIGN PATENT DOCUMENTS

CN 203047755 U 7/2013
EP 2392224 A1 12/2011
(Continued)

OTHER PUBLICATIONS

International Search Report related to Application No. PCT/FR2018/052362; reported on Dec. 5, 2018.

*Primary Examiner* — Andrew T Kirsch
(74) *Attorney, Agent, or Firm* — von Briesen & Roper, s.c.

(57) ABSTRACT

A refillable device for packaging cosmetic product, comprising a removable container containing cosmetic product, an outer casing defining a housing for receiving the removable container, the housing for receiving the removable container being open at an outlet in the outer casing, and a lid adapted to seal closed the outlet of the housing in the outer casing. The removable container is attached to the outer casing by the elastic interlocking of complementary reliefs. The removable container can be reversibly removed from the outer casing. The lid is adapted to be attached to one among the lid and the removable container so as to lock in place the elastic interlocking of the complementary relief portions.

20 Claims, 9 Drawing Sheets

(56) References Cited

U.S. PATENT DOCUMENTS

| | | | | |
|---|---|---|---|---|
| 8,448,822 | B2 * | 5/2013 | Rousselet ..... | A45D 40/0068<br>222/256 |
| 8,561,825 | B1 * | 10/2013 | Kino ..... | B65D 81/3869<br>220/592.16 |
| 2006/0196804 | A1 | 9/2006 | Tsugio | |
| 2013/0161345 | A1 | 6/2013 | Tatin | |

FOREIGN PATENT DOCUMENTS

| | | | |
|---|---|---|---|
| FR | 2745276 | A1 | 8/1997 |
| FR | 2786076 | A1 | 5/2000 |
| FR | 2973666 | A1 | 10/2012 |
| FR | 2995199 | A1 | 3/2014 |
| JP | 2003040331 | A | 2/2003 |
| JP | 4248774 | B2 | 4/2009 |
| JP | 2009269629 | A | 11/2009 |
| JP | 2010195484 | A | 9/2010 |
| JP | 5049865 | B2 | 10/2012 |
| JP | 2013075673 | A | 4/2013 |
| JP | 5331720 | B2 | 10/2013 |
| JP | 2016222287 | A | 12/2016 |
| KR | 101211964 | B1 | 12/2012 |
| KR | 101457810 | B1 | 11/2014 |
| KR | 20160088073 | A | 7/2016 |
| KR | 101677336 | B1 | 11/2016 |
| TW | M365672 | U | 10/2009 |
| WO | WO 2018/115685 | A1 | 6/2018 |

* cited by examiner

REFILLABLE DEVICE FOR PACKAGING A COSMETIC PRODUCT

CROSS-REFERENCE TO RELATED APPLICATION

This Application is a 35 USC § 371 US National Stage filing of International Application No. PCT/FR2018/052362 filed on Sep. 25, 2018 and claims priority under the Paris Convention to French Patent Application No. 17 58857 filed on Sep. 25, 2017.

FIELD OF THE DISCLOSURE

The present invention relates to a refillable device for packaging a cosmetic product, and to a removable container intended to be implemented in such a refillable device. The invention also relates to a cosmetic product refill and a method for replacing the removable container of such a device.

In the cosmetic field in particular, users are particularly sensitive to the aesthetics of packaging devices. However, the cost of aesthetic packaging devices is high and further increases the price of the cosmetics commercially sold in this form.

BACKGROUND OF THE DISCLOSURE

An idea has emerged which consists of providing an aesthetic packaging device, including a separate container that is less aesthetic but has cheaper packaging. Preferably, the container is removable so that the packaging device can be refilled by replacing the removable container.

For example, application FR-A-2995199 describes a pot for a cosmetic product comprising a casing forming a neck defining an upper edge of the casing, and an insert containing the cosmetic product received in the casing. A lid can be screwed onto an external thread on the outer surface of the neck. However, in that document, the insert is not intended to be replaced. As a result, the main disadvantage of this pot is that it is not refillable.

To make such an insert removable, FR-A-2745276 suggests forming a small hole between the bottom of the casing and the housing receiving the insert, so as to be able to pass a thin object through it and push the insert from below.

However, depending on the material from which the insert is made, the operation of pushing the insert from below can simply lead to deforming the insert, with a risk of expelling cosmetic product. In addition, it is necessary to use a tool that is insertable into the hole in the bottom of the casing.

In addition, application TWM365672 describes a pot comprising a casing having a housing of non-circular cross-section, receiving a cosmetic product refill of cross-section complementary to the housing. A ring is screwed onto the casing, above the refill, leaving a threaded edge of the refill protruding from the ring. A lid is screwed onto this threaded edge.

The pot as described in TWM365672 is not very aesthetic, however, with backlash existing between the ring and the threaded edge of the refill to allow the passage of the threaded edge into the opening formed by the ring.

An object of the invention is to provide a refillable device for packaging cosmetic product that does not have at least some of the aforementioned disadvantages. In particular, the invention aims to provide a refillable packaging device in which the removable container can easily be replaced, while ensuring satisfactory attachment of the removable container, particularly when the lid of the packaging device is closed.

SUMMARY OF THE DISCLOSURE

To this end, the invention proposes a refillable device for packaging cosmetic product, comprising:

- a removable container containing cosmetic product,
- an outer casing defining a receiving housing for the removable container, the receiving housing for the removable container being open at an outlet in the outer casing, the removable container being attached to the outer casing by the elastic interlocking of complementary reliefs, the removable container being reversibly removable from the outer casing,
- a lid adapted to seal closed the outlet of the housing in the outer casing, wherein the lid is adapted to be attached to one among the outer casing and the removable container so as to lock in place the elastic interlocking of the complementary reliefs.

Thus, advantageously, once the lid is attached on the removable container, it is no longer possible to remove the removable container from the outer casing. This eliminates any risk of inadvertently removing the removable container from the outer casing.

Nevertheless, it remains possible to replace the removable container, in particular by taking off the lid before removing the removable container from the outer casing.

Advantageously, this removal of the removable container is reversible, meaning that the removed removable container can be reattached to the outer casing by the elastic interlocking of complementary reliefs.

According to preferred embodiments, the refillable packaging device according to the invention comprises one or more of the following features, alone or in combination:

- the lid is adapted to be directly attached to one among the outer casing and the removable container, preferably to the removable container, so as to lock in place the elastic interlocking of the complementary reliefs;
- the removable container forms an external thread and the lid forms a complementary internal thread so that the lid is directly attached to the removable container by screwing;
- the removable container is attached to the outer casing by means of a ferrule, the ferrule being directly attached on the outer casing, the removable container being elastically interlocked on the ferrule by the engagement of complementary reliefs of the ferrule and removable container:
- the removable container is directly attached on the outer casing by the elastic interlocking of complementary reliefs of the removable container and outer casing;
- one of the complementary reliefs is a groove and another of the complementary reliefs is a tongue having a bead adapted to be received in the groove;
- the removable container has a bottom, and the bottom of the removable container is shaped to cause imbalance of the removable container when the bottom of the removable container is placed on a flat support, the bottom of the removable container being formed for example by a protruding relief, the bottom of the removable container preferably further being formed by an apex of the protruding relief;
- the bottom is created by a face of a protruding relief, preferably flat, the center of said face being such that the line joining said center with the center of gravity of the removable container forms a non-straight angle with the direction of the weight of said removable container, when the bottom thereof is placed on a flat support;

the outer casing has a bottom, the bottom of the outer casing preferably being recessed with respect to an area of contact of the outer casing bearing on a flat support;

the outer casing has a through-hole from the bottom of the outer casing and into the receiving housing of the removable container, the diameter of the through-hole preferably being greater than or equal to 10 mm, or possibly even greater than or equal to 15 mm;

the outer casing has an opening that is opposite to the outlet with respect to the housing in the outer casing, the opening being of dimensions that allow inserting the removable container into the housing in the outer casing.

the ferrule has at least one tongue, preferably at least three tongues, more preferably at least three tongues that are uniformly distributed angularly, and the removable container has at least one groove adapted to receive beads of the tongue or tongues;

the removable container has at least one tongue, preferably at least three tongues, more preferably at least three tongues that are uniformly distributed angularly, and the outer casing has at least one groove adapted to receive beads of the tongue or tongues;

the removable container forms a rim having a substantially U-shaped cross-section, the rim being adapted to cover an edge of the outer casing around the outlet;

the lid is adapted to be attached on the removable container by screwing, elastic interlocking, clamping, or by means of a bayonet attachment;

the lid has a radially inner wall provided with a thread intended to engage with a complementary thread on the removable container;

the packaging device comprises a gasket of cross-section substantially complementary to the cross-section of the orifice of the removable container, the gasket preferably being attached to the lid, the gasket sealing closed the orifice when the lid is attached to the removable container;

the packaging device comprises a gasket, preferably attached to the lid, the gasket extending substantially along the edge of the orifice of the removable container such that the gasket is received in or around the orifice of the removable container when the lid is attached to the removable container;

the lid is of one among: wood, a ceramic material, metal, porcelain, rigid foam for example polyurethane, natural stone, synthetic stone, stone powder mixed with a binder, injection-molded, leather, glass, crystal, plastic, particularly thermosetting plastic or thermoplastic plastic, and/or in particular plastic that is frosted and/or varnished and/or painted and/or metallized and/or galvanized and/or provided with visual effects, natural fabric, or synthetic fabric;

the outer casing and/or the lid are translucent, possibly even transparent;

the outer casing is of one among: glass, metal, ceramic, porcelain, crystal, and plastic, particularly polymethyl methacrylate, polystyrene, polycarbonate, polyethylene terephthalate, ionomer resin such as the ethylene-vinyl copolymer known by the trade name Surlyn®, natural stone, synthetic stone, ceramic, porcelain, wood, and urea-formaldehyde; and the ferrule is of one among the following materials: plastic, particularly thermoplastic, copolyester, polyamide, polyolefin for example polypropylene, polyacetal, or metal, particularly stainless steel or aluminum.

According to another aspect, the invention relates to a removable container for cosmetic product for a refillable packaging device as described above in any of its combinations, the removable container having a bottom, an orifice, and a side wall between the bottom and the orifice, wherein the removable container is adapted to be attached to the outer casing by the elastic interlocking of complementary reliefs, the removable container being reversibly removable from the outer casing.

The removable container is advantageously adapted to allow the attachment of a lid to seal closed the orifice, in particular by screwing.

Preferably, the removable container comprises cosmetic product, preferably in the form of cream, paste, powder, gel, liquid, or single-unit solid.

Preferably, the removable container comprises a membrane seal sealing closed the orifice.

Also preferably, the removable container is of one among: aluminum, an aluminum alloy, steel, glass, plastic, ceramic, porcelain, cardboard, particularly coated cardboard or a multi-ply cardboard coated with other materials such as metal foils or plastic sheets.

According to another aspect, the invention relates to a cosmetic product refill comprising a removable container as described above in any of its combinations and a lid, preferably attached to the removable container.

The cosmetic product refill may comprise a gasket sandwiched between the removable container and the lid.

Finally, according to another aspect, the invention relates to a method for replacing a removable container in a refillable device for packaging cosmetic product as described above in any of its combinations, the method comprising the steps of:

detaching the lid from the refillable device;

removing the removable container from the refillable device;

providing a new removable container, attaching the removable container in the outer casing by fitting together the elastically interlocking complementary reliefs; and attaching the lid of the refillable device or a new lid on the removable container or on the outer casing, this attachment of the lid on the removable container locking in place the elastic interlocking of the elastically interlocking complementary reliefs.

BRIEF DESCRIPTION OF THE DRAWINGS

The invention will be better understood from the description which follows, given with reference to the accompanying drawings in which.

Figure 1:
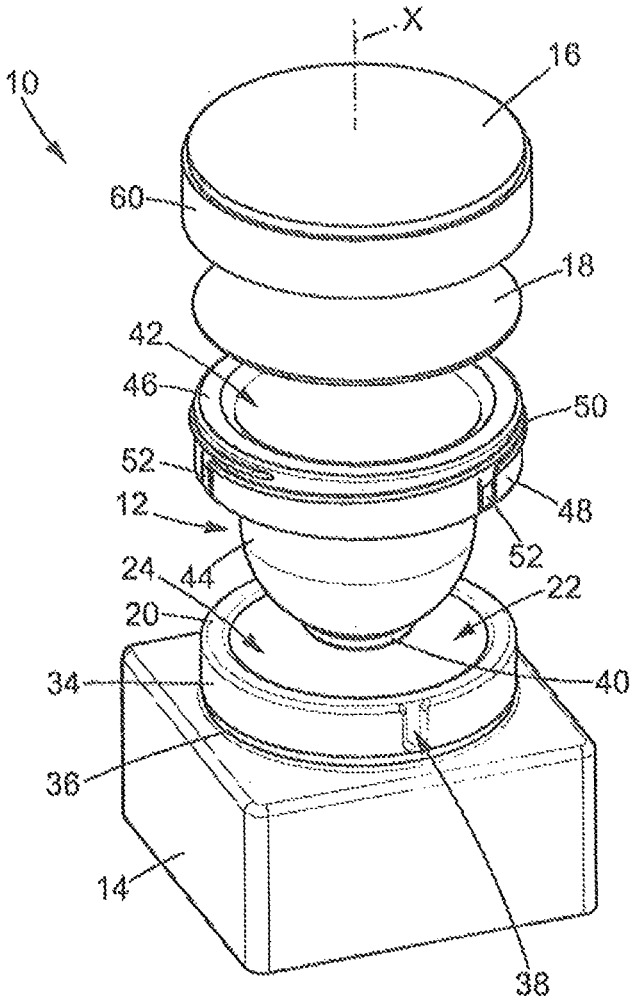
FIG. 1 represents an exploded view of a first example of a refillable device for packaging cosmetic product.

In the remainder of the description, elements that are identical or of identical function bear the same reference. For brevity in the present description, these elements are not described in detail in each example. Only the differences between the embodiments are described in detail.

FIGS. 1 to 8 illustrate a first example of a refillable device for packaging cosmetic product 10 (hereinafter a packaging device 10). This packaging device 10 essentially comprises a removable container 12 of cosmetic product, an outer casing 14 receiving the removable container 12, a lid 16, and a gasket 18. The gasket 18 is intended to prevent the product cosmetic contained in the removable container 12 from drying out.

DETAILED DESCRIPTION OF THE DISCLOSURE

More specifically, the outer casing 14 defines a housing 20 intended to receive at least part of the removable container 12. The housing 20 is open at an outlet 22 in the outer casing 14. The outer casing 14 also forms an edge 24 around the outlet 22. Here, the outer casing 14 is shaped to allow placing the outer casing 14 stably on a flat support. As illustrated, the outer casing 14 rests on such a flat support by a bearing area 26 surrounding a bottom 28 which is recessed relative to the bearing area 26. In a variant, the bottom 28 is not recessed relative to the bearing area 26; on the contrary, it is part of this bearing area 26. The bearing area 26 has for example a closed contour, in particular a circular or elliptical contour, or any other form. Alternatively, the bearing area 26 is formed, as illustrated, by feet separate from the outer casing 14. The bottom 28 of the outer casing 14 may possibly have a through-hole 30, leading from the bottom 28, at the exterior of the outer casing 14, and into the housing 20. The hole 30 advantageously allows the passage of a finger. To allow this, the hole 30 may have a diameter of at least 10 mm, preferably at least 15 mm. According to an embodiment not shown, the flat bottom 28 of the outer casing 14 is at least partially covered by a label, the label possibly covering the hole 30. The label may for example bear any information relating to the brand of the product and/or its composition and/or its method of application and/or its possible expiration date.

Between the bearing area 26 and the edge 24 of the outlet 22, the outer casing 14 essentially forms a lower portion 32 of substantially parallelepiped external shape, and an upper portion 34 of tubular shape forming a neck. Of course, this shape of the outer casing 14 is not limiting, as it may have substantially any shape, in particular any shape intended to ensure the aesthetics of the packaging device 10. A substantially circular groove 36 is made at the base of the neck 34 of the outer casing 14. A vertical notch 38 is also made in the neck 34 of the outer casing 14.

The outer casing 14 is preferably translucent, possibly even transparent. This gives the outer casing 14 and the packaging device 10 an aesthetic effect appreciated by users. The outer casing 14 may also be opaque.

The outer casing 14 may in particular be made of one among: glass, metal, ceramic, porcelain, crystal, and plastic, particularly polymethyl methacrylate, polystyrene, polycarbonate, polyethylene terephthalate, ionomer resin such as the ethylene-vinyl copolymer known by the trade name Surlyn®, natural stone, synthetic stone, ceramic, porcelain, wood, and urea-formaldehyde.

Furthermore, the removable container 12 has a bottom 40, an orifice 42, and a side wall 44 between the bottom 40 and the orifice 42. Here, the bottom 40 of the removable container 12 has the shape of a nipple, substantially flat. As a result, when the removable container 12 is placed with the bottom 40 on a flat support, the removable container 12 is unbalanced. This makes it more difficult to use the removable container 12 when it is not assembled in the outer casing 14. This is particularly true in the case where the cosmetic product contained in the removable container is in the form of powder, liquid, or cream, which tend to flow out of the removable container 12 when it is not kept vertical.

Figure 2:
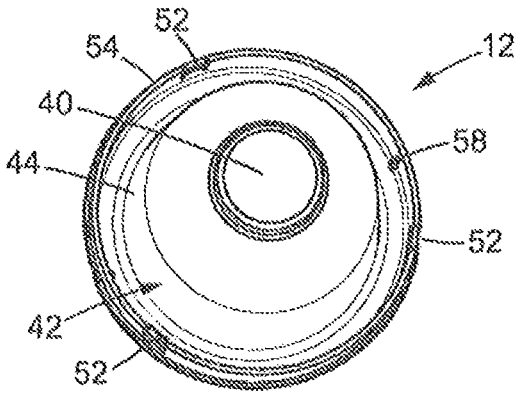
FIG. 2 is a perspective view from below of an empty removable container that can be used in the refillable device for packaging cosmetic product of FIG. 1.
Figure 3:
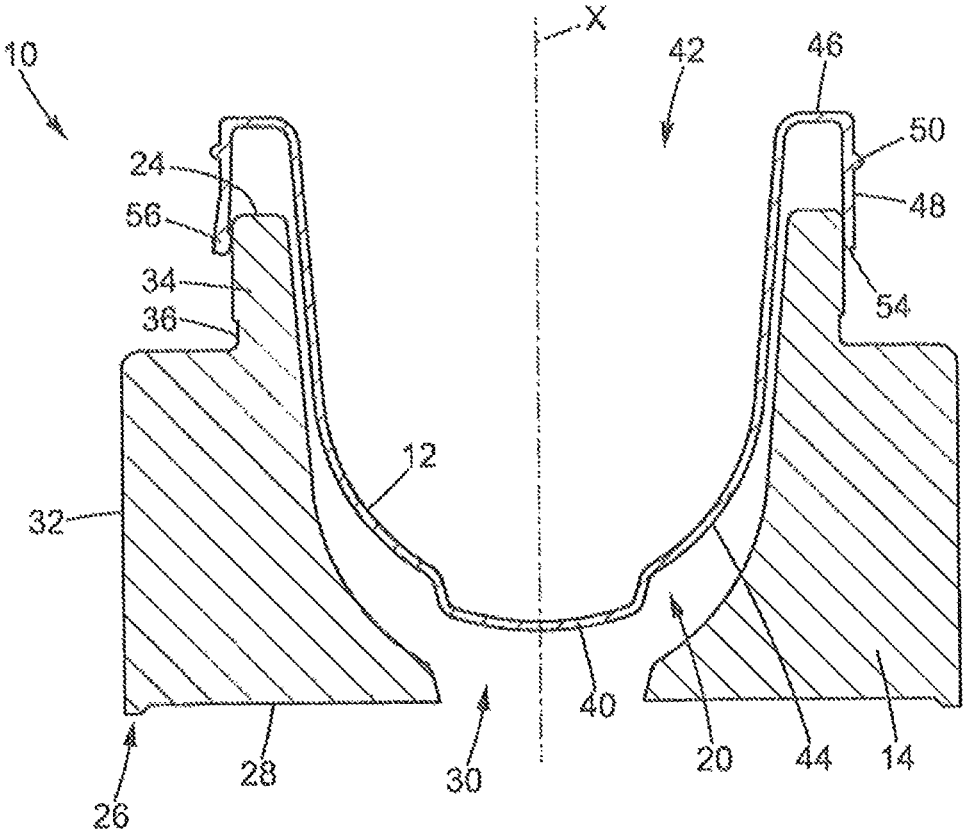
FIG. 3 represents a longitudinal section of the refillable device for packaging cosmetic product of FIG. 1, without its lid.

Moreover, according to the example of FIGS. 1 to 3, the side wall 44 of the removable container 12 has a substantially hemispherical shape, flared towards the orifice 42. However, other shapes of the side wall 44 of the removable container 12 are conceivable. However, the side wall 44 of the removable container 12 preferably has a flared shape from the bottom 40 to the orifice 42, to facilitate user access to all of the cosmetic product contained in the removable container 12.

Here, the side wall 44 of the removable container 12 forms a rim 46 around the orifice 42. In other words, the side wall 44 is folded around the orifice 42. The rim 46 is shaped to receive the neck 34 of the outer casing 14. In particular, the width of this rim 46 is substantially equal to the width of the neck 34 of the outer casing 14. Also, a fold 48 radially surrounding the rim 46 externally, is of a length substantially equal to the height of the neck 34 of the outer casing 14 plus the width of the groove 36 formed at the base of the neck 34. On its radially outer face, the fold 48 has an external thread 50.

The fold 48 also has at least one tongue 52. In the current case, the fold 48 has three tongues 52. The tongues 52 here are uniformly distributed angularly on the fold 48. The tongues 52 are arranged under the external thread 50, meaning between the external thread 50 and the free end 54 of the fold 48. The tongues 52 are cut in the fold 48. In other words, the tongues 52 are separated from the rest of the fold 48 by two spaces, arranged one on each side of each of the tongues 52. At its lower end and on its radially inner face, each tongue 52 has a bead 56, its cross-section being substantially complementary to the cross-section of the groove 36 at the base of the neck of the outer casing 14.

Finally, a stop 58 is provided on the radially inner face of the fold 48. The stop 58 is created in the form of a relief protruding from the radially inner face of the fold 48, extending primarily in the direction of the X axis, the center line of the refillable device 10 for packaging cosmetic product. The stop 58 is shaped to be received in the notch 38 formed in the neck 34 of the outer casing 14. This stop 58 can thus allow indexing of the removable container 12 on the outer casing 14. In other words, the stop 58 engaging with the notch 38 makes it possible to fix the relative angular position of the removable container 12 with respect to the outer casing 14, about the X axis.

The removable container 12 may be made in particular of aluminum, aluminum alloy, steel, glass, plastic, ceramic, porcelain, cardboard, particularly coated cardboard or multiply cardboard coated with other materials such as metal foils or plastic sheets. Depending on the materials used, the creation of the removable container is more or less easy and therefore expensive. More noble materials such as porcelain, ceramic, or glass may be chosen to ensure an aesthetic and high-quality effect which is appreciated and desired by users. The use of these materials can also contribute to the aesthetic effect of the packaging device 10, particularly when the outer casing 14 is translucent or transparent.

The removable container 12 may in particular comprise a cosmetic product in the form of cream, paste, powder, gel, liquid, or single-unit solid.

Finally, the lid 16 is adapted to seal closed the orifice 42 of the removable container 12.

The lid 16 has an outer wall 60 which can take any desired shape, in particular in order to obtain an aesthetic effect of the packaging device 10.

An inner wall 62 of the lid 16 defines an open cavity. This inner wall 62 is provided with a thread 64. The thread 64 allows attaching the lid 16 on the removable container 12 by engagement with the external thread 50 on the fold 48 of the removable container 12. Preferably, the lid 16 and the removable container 12 are shaped to clamp the gasket 18 when the lid 16 is attached on the removable container 12. In particular, as is for example visible in FIG. 5, when the lid 16 is attached on the removable container 12, the gasket 18 is clamped between the bottom 66 of the lid and the rim 46 of the removable container 12, in particular the top of the rim 46 of the removable container 12.

The lid 16 may be translucent, possibly even transparent, or conversely may be opaque.

The lid 16 is for example made of one among wood, a ceramic material, metal, porcelain, rigid foam for example polyurethane, natural stone, synthetic stone, stone powder mixed with a binder, injection-molded, leather, glass, crystal, plastic, particularly thermosetting plastic such as urea-formaldehyde or thermoplastic plastic, and/or in particular plastic that is frosted and/or varnished and/or painted and/or metallized and/or galvanized and/or provided with visual effects, natural fabric, or synthetic fabric, or any other known material for creating a lid.

The packaging device 10 may be sold fully assembled. Alternatively, the packaging device 10 is sold as a kit. In that case, the assembly of such a packaging device 10 may be carried out as follows.

Figure 4:
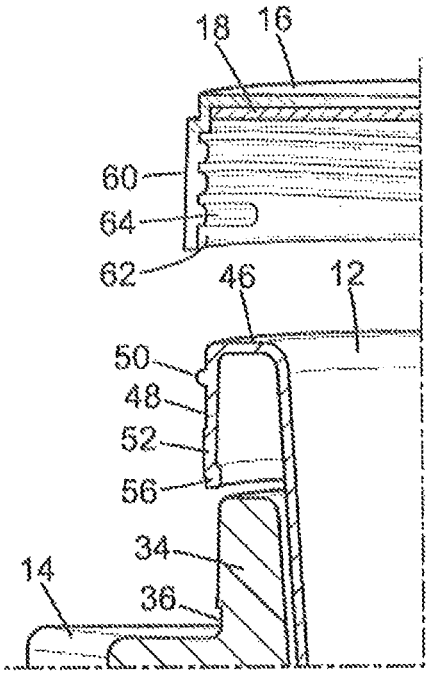
FIGS. 4 to 7 illustrate, in partial sectional views, steps of assembling the removable container of FIG. 2 in the refillable device for packaging cosmetic product of FIG. 1.
Figure 5:
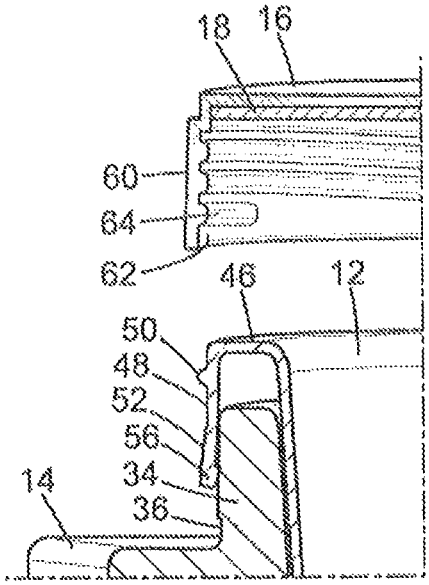
Figure 6:
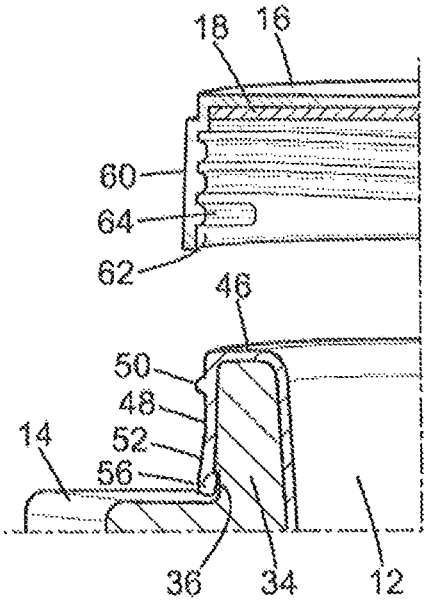

Firstly, as illustrated by FIGS. 4 to 6, the removable container 12 is partially inserted into the housing 20 formed by the outer casing 14. Due to this partial insertion, the beads 56 at the end of the tongues 52 of the removable container 12 are not elastically interlocking with the complementary groove 36 formed at the base of the neck 34 of the outer casing 14. In this position, the tongues 52 are elastically deformed. As illustrated in FIG. 6, the beads 56 may be arranged substantially opposite the groove 36 at the base of the neck 34 of the outer casing 14. Thus, preferably, the insertion of the removable container 12 into the housing 20 is done to a sufficiently large depth that the stop 58 on the inner face of the fold 48 is received in the notch 38 formed in the neck 34 of the outer casing 14.

Next, the removable container 12 is pushed towards the outer casing 14 so that the beads 56 are received in the groove 36, as illustrated in FIG. 6. The elastic interlocking (or "snap-fitting") of the removable container 12 on the outer casing 14 is thus enabled. More particularly, it is possible to fix the removable container 12 on the outer casing by elastically interlocking the beads 56 of the tongues 52 of the removable container 12 with the complementary groove 36 formed at the base of the neck 34 of the outer casing 14.

Preferably, in this position the tongues 52 are not elastically deformed.

Figure 7:
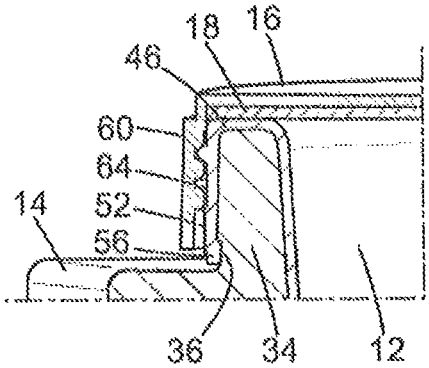
Figure 8:
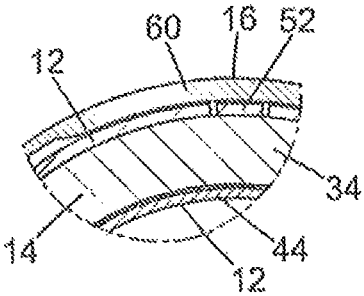
FIG. 8 shows a detailed cross-section of the refillable device for packaging cosmetic product of FIG. 1.
Figure 9:
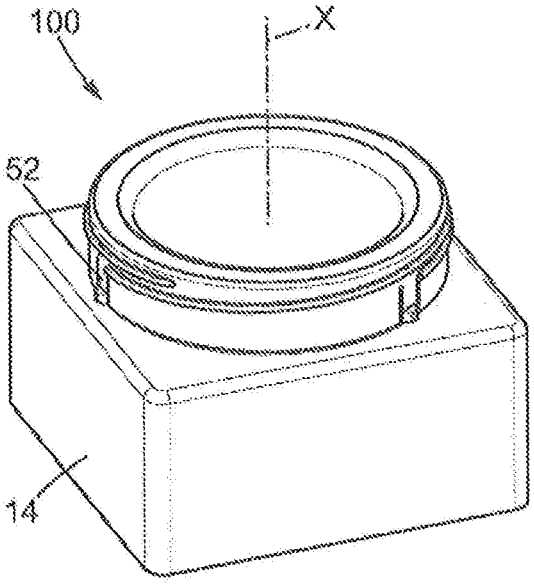
FIG. 9 shows a perspective view of an outer casing of a second example of a refillable device for packaging cosmetic product to which a removable container is attached.
Figure 10:
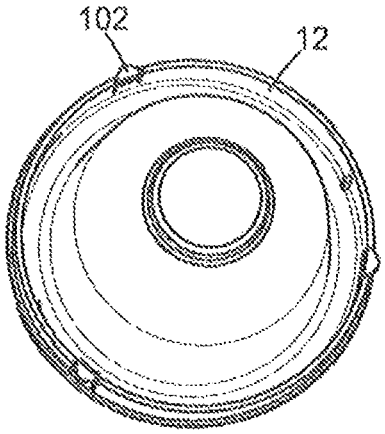
FIG. 10 shows a perspective view from below of an empty removable container that can be used in the refillable device for packaging cosmetic product according to the second example.
Figure 11:
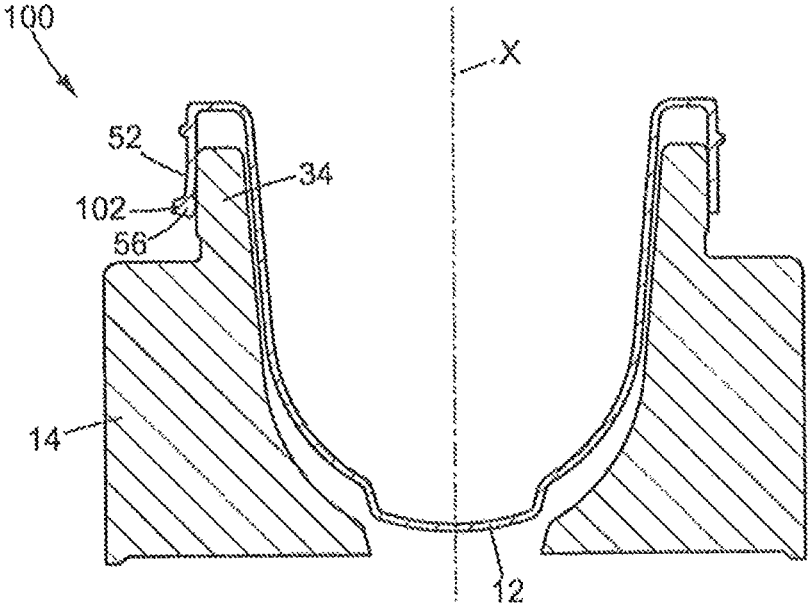
FIG. 11 is a longitudinal section of the outer casing and removable container of FIG. 9.
Figure 12:
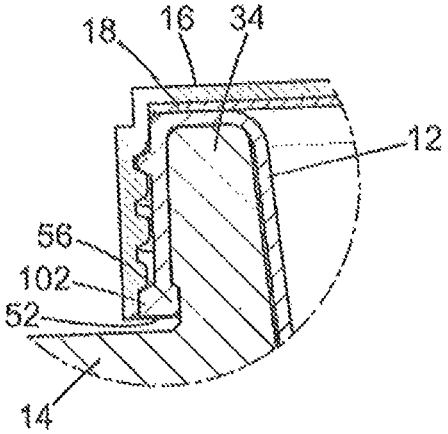
FIG. 12 shows a detailed longitudinal section of the second example of a refillable device for packaging cosmetic product.
Figure 13:
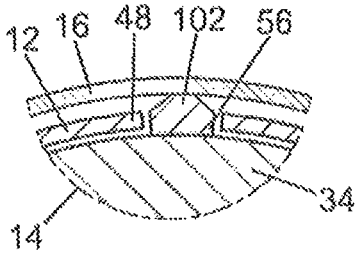
FIG. 13 shows a detailed cross-section of the second example of a refillable device for packaging cosmetic product.

Finally, as illustrated in FIG. 7, the lid 16 is screwed onto the removable container 12. The screwing of the lid 16 onto the removable container makes it possible to lock the elastic interlocking of the removable container 12 with the outer casing. Indeed, as is particularly visible in FIGS. 7 and 8, the lid 16, screwed on the removable container 12, prevents any elastic deformation of the tongues 52 which would allow the beads 56 of the tongues 52 to withdrawn from the groove 36 at the base of the neck 34 of the outer casing 14. In the position where the lid 16 is screwed on the removable container 14, the fold 48 and the tongues 52 in particular are sandwiched, preferably substantially without backlash, between the inner wall 62 of the lid 16 and the neck 34 of the outer casing 14.

It should be noted here that the screwing of the lid 60 on the removable container 12 is facilitated because the stop 58 is received in the notch 38 in the neck 34 of the removable container. This stop 58 thus restricts the relative rotation of the removable container 12 with respect to the outer casing 14. Also, while holding the outer casing 14 with one hand, the lid 16 can be screwed onto the removable container 12 with the other hand.

It is of particular interest that the lid 16 is attached on the removable container 12. Indeed, the attaching reliefs (here a thread, but other fastening means can be envisaged, in particular elastically interlocking reliefs for example) may contain deposits of cosmetic product. By replacing the removable container 12 and/or the lid 16, these deposits of cosmetic product are eliminated. In addition, this makes it possible to market refills composed of a removable container 12 and a lid 16, which allows regularly changing the shape of the lid 16 and thus changing the shape of the refillable device for packaging cosmetic product 10. The shape and/or color of the lid may also be changed according to the cosmetic product in the associated removable container 12 in order to form a cosmetic product refill.

The removable container 12 may be provided with a membrane seal. This membrane seal may be removed from the removable container 12, before or after its insertion into the outer casing 14. The membrane seal, possibly provided with a gasket, seals the removable container 12 before it is opened. Advantageously, the membrane seal cannot be replaced on the removable container 12, so the cosmetic product cannot be preserved after opening if not in the packaging device 10. Indeed, only the packaging device 10 allows closing the open removable container 12, by means of the lid 16, while providing a suitable seal by means of the gasket 18.

Once the entire contents of the removable container 12 have been used, the user can remove the removable container 12 from the packaging device 10. To remove the removable container 12, a user must first remove the lid 16. Only then can the user remove the removable container 12. The removal of the removable container 12 out of the outer casing 14 may for example be done by pushing on the removable container 12 through the opening 30 in the bottom 28 of the outer casing 14, or preferably by pulling on the removable container or on one of the tabs 52 to release the corresponding bead 56 from the groove 36.

Interestingly, the removal of the removable container 12 from the outer casing 14 can be done reversibly. In other words, this removal is achieved without damage to the removable container 12 or outer casing 14. In particular, the tabs 52 are not plastically deformed, which would prevent them from returning to their original shape, nor are they torn. These tabs 52 can thus again allow the beads 56 to be elastically fitted into the groove 36. The removable container 12 can thus be reused or can be assembled and disassembled multiple times on an outer casing.

Once the old removable container 12 has been removed, the user can then insert a new removable container 12 by proceeding as described above.

FIGS. 9 to 13 illustrate a variant 100 of the refillable device for packaging cosmetic product 10 according to the first example described.

In this variant, the tabs 52 on the fold 48 of the removable container 12 form not only a bead 56 received in the groove 36 at the base of the neck 34 of the outer casing, but also a bead 102. This bead 102 is oriented radially outward to the removable container 12. Bead 102 allows, by engagement with the thread 64 inside the lid, gripping the tabs 52 even more intimately between the lid 18 and the neck 34 of the outer casing 14, as is particularly visible in FIG. 13. Indeed, this bead 102 oriented radially outward restricts or even nullifies any backlash between the lid 16 and the tab 52, at the free end 54 of the tab 52. This reduced play is particularly visible by comparing FIGS. 7 and 12.

Finally, FIGS. 14 to 20 illustrate a third example 200 of a refillable device for packaging cosmetic product.

According to this example, the removable container 12 is not directly attached on the outer casing 14. The removable container 12 is attached to the outer casing.

Here, "directly attached on" is understood to mean that the attachment occurs at at least one surface of the removable container and a surface of the outer casing 14 which are in contact with one another. In other words, the removable container 12 is directly connected to the outer casing 14. In particular, in the case of elastic interlocking, "directly attached on" means that one elastically interlocking relief is created by the removable container 12 while the other elastically interlocking relief is formed by the outer casing 14.

"Attached to" means, more generally, that although the removable container 12 is made integral with the outer casing 14, the removable container 12 may not be directly connected to the outer casing 14. In particular, the attachment may not occur at surfaces of the outer casing and the removable container that are in contact. However, there may be contact between the removable container 12 and the outer casing 14, but this contact is not of a type that integrally secures the removable container 12 and outer casing 14. This integral securing can then be carried out indirectly, by means of one or more intermediate parts.

Thus, in the refillable device for the packaging of a cosmetic product 200 according to FIGS. 13 to 20, the removable container 12 is attached to the outer casing 14 by means of a ferrule 202. Here, the ferrule 202 forms a first collar 204 of large diameter, a second collar 206 of small diameter, and a ring-shaped portion 208 which connects the first and second collars 204, 206 together. The second collar 206 extends over substantially the entire height of the ferrule 202. Conversely, the first collar 204 extends over only a portion of the height of the ferrule 202. In particular, the first collar 204 extends over substantially half the height of the ferrule 202. The ferrule 202 thus has an "h" cross-section.

The first collar 204 forms reliefs 210 on its radially inner face, intended to be received in complementary housings 212 created in the neck 34 of the outer casing 14. It should be noted here that the outer casing 14 is without a circular groove 36 at the base of the neck 34. The housings 212 may in particular be formed as flat areas 214 or recesses 216 in the radially outer surface of the neck 34. The reliefs 210 on the first collar 204 may in particular take the form of tongues extending primarily in a radial direction.

The ferrule 202 may be shaped to be tightly mounted on the neck 34 of the outer casing. The radial distance between the first and second collars 204, 206 is then equal to or even substantially less than the thickness of the neck 34 of the outer casing 14. The height of the neck 34 is substantially equal to the height of the first collar 204 such that when the ferrule is mounted tightly on the neck 33, the top of the neck 34 is bearing against the ring-shaped portion 208 of the ferrule, while the free end of the first collar 204 bears against the portion of the outer casing 34 at the base of the neck 34.

The second collar 206 forms reliefs 218, on a lower portion intended to be oriented towards the outer casing 14. As is more particularly visible in FIG. 14, these reliefs 218 have a substantially half-disk shape, its base being oriented downward.

The second collar 206 also forms tabs 220, on an upper portion intended to be oriented opposite the outer casing 14. These tabs 220 have a bead 222 oriented radially inward. The tabs 220 may be implemented substantially identically to the tabs 52 of the first and second examples described above.

Finally, in the embodiment of FIGS. 14 to 20, the removable container 12 has housings 224 on its radially outer surface, of a shape substantially complementary to the reliefs 218 formed on the radially inner wall of the lower portion of the first collar 204.

The removable container 12 also has a circular groove 226 on its radially outer surface and, between the circular groove 226 and a free end 228 of its side surface 44, a thread 50 intended to engage with a complementary thread 64 of the lid 16.

Figure 14:
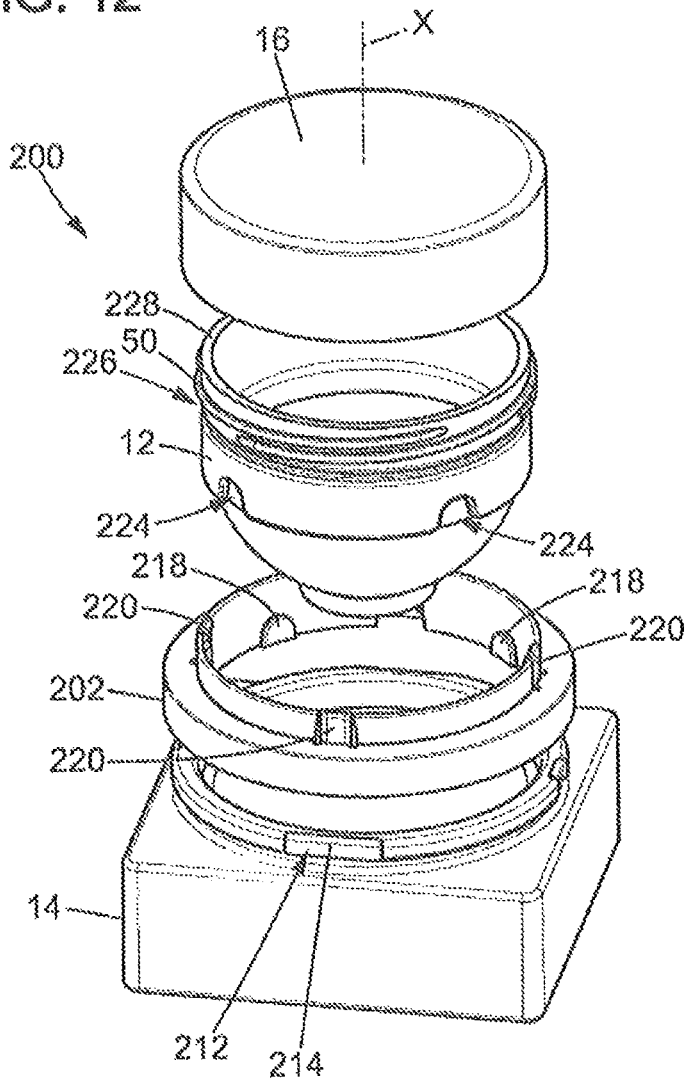
FIG. 14 shows an exploded view of a third example of a refillable device for packaging cosmetic product.

The assembly of the refillable device for packaging cosmetic product 200 according to FIG. 14 can be carried out as follows.

Firstly, the ferrule 202 is mounted on the neck 34 of the outer casing 14. This assembly may be implemented by forcibly inserting the neck 34 of the outer casing 14 into the space defined by the first and second collars 204, 206 and the ring-shaped portion 208. During this insertion, the reliefs 210 formed on the radially inner face of the first collar 204 are inserted into the housings 212 formed in the radially outer surface of the neck 34 of the outer casing 14. Relative rotation of the ferrule 202 with respect to the outer casing is thus restricted or even prevented. The ferrule 202 is advantageously not detachable from the outer casing 14.

Figure 15:
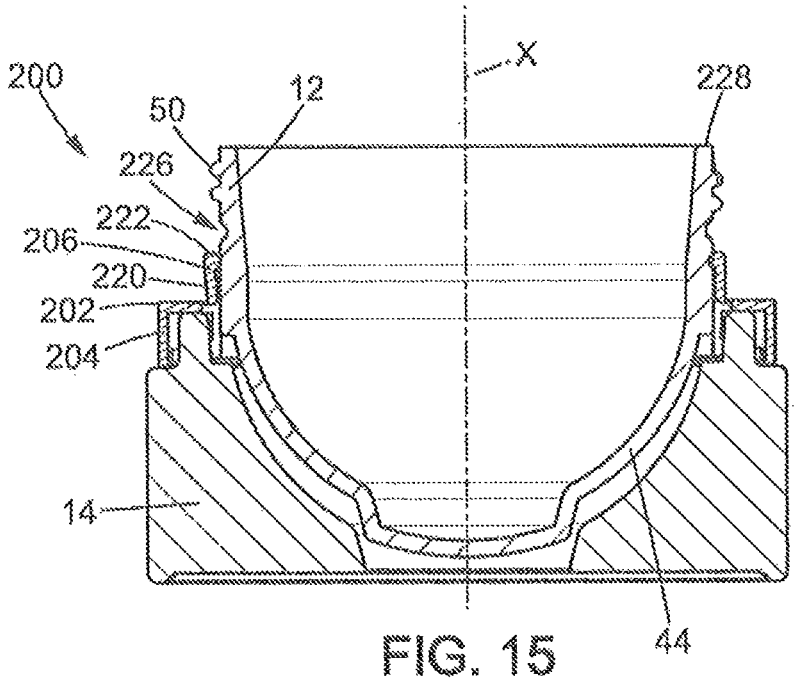
FIG. 15 shows the third example of a refillable device for packaging cosmetic product, viewed in longitudinal section without its lid.
Figure 16:
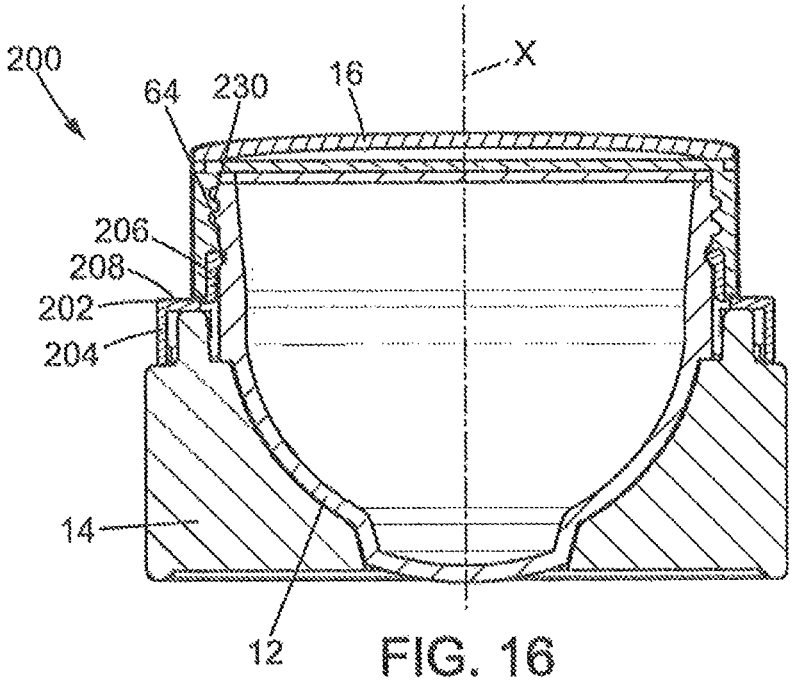
FIG. 16 shows the third example of a refillable device for packaging cosmetic product, viewed in longitudinal section.
Figure 17:
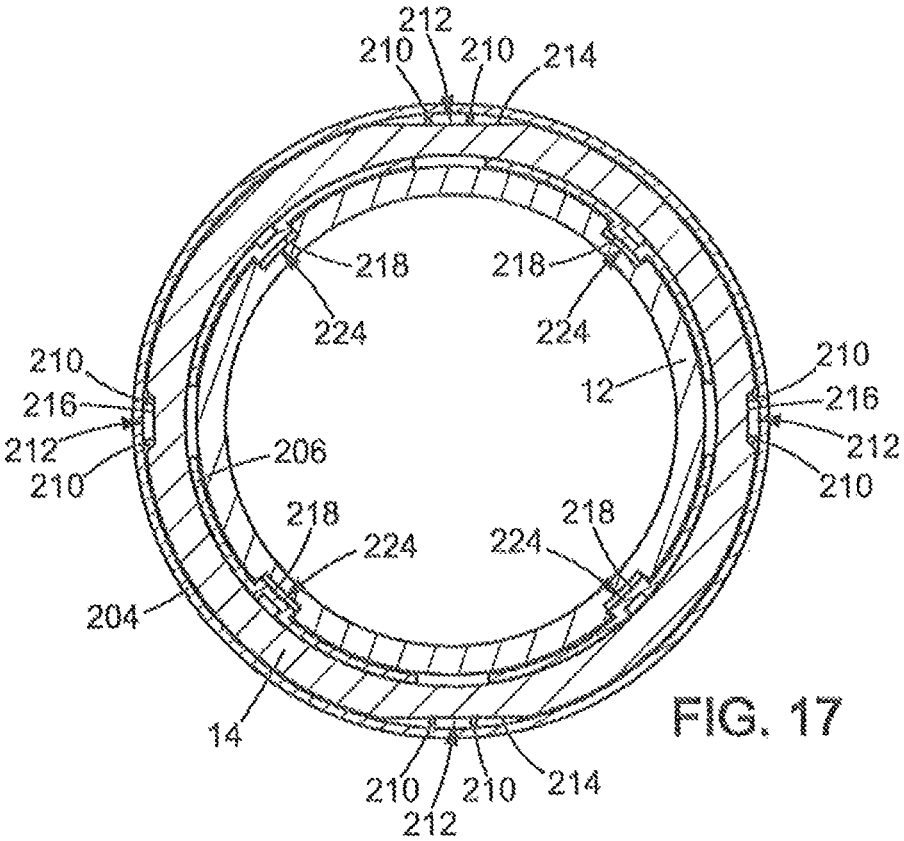
FIG. 17 shows the third example of a refillable device for packaging cosmetic product, viewed in cross-section.
Figure 18:
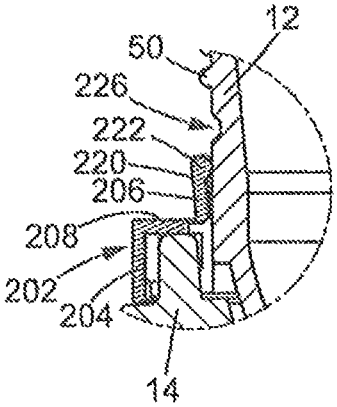
FIG. 18 shows details of the assembly of a removable container on an outer casing of the third example of a refillable device for packaging cosmetic product, viewed in longitudinal section.
Figure 19:
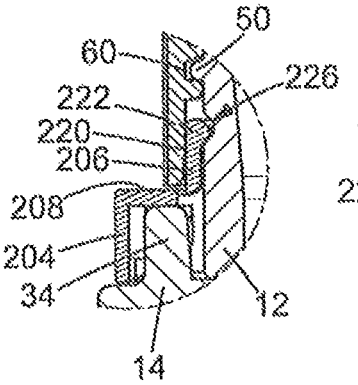
FIG. 19 is a view similar to FIG. 18 with the lid assembled on the refillable device for packaging cosmetic product.
Figure 20:
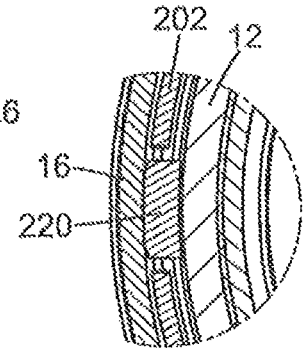
FIG. 20 shows details of the refillable device for packaging cosmetic product according to the third example, viewed in cross-section.
Figure 21:
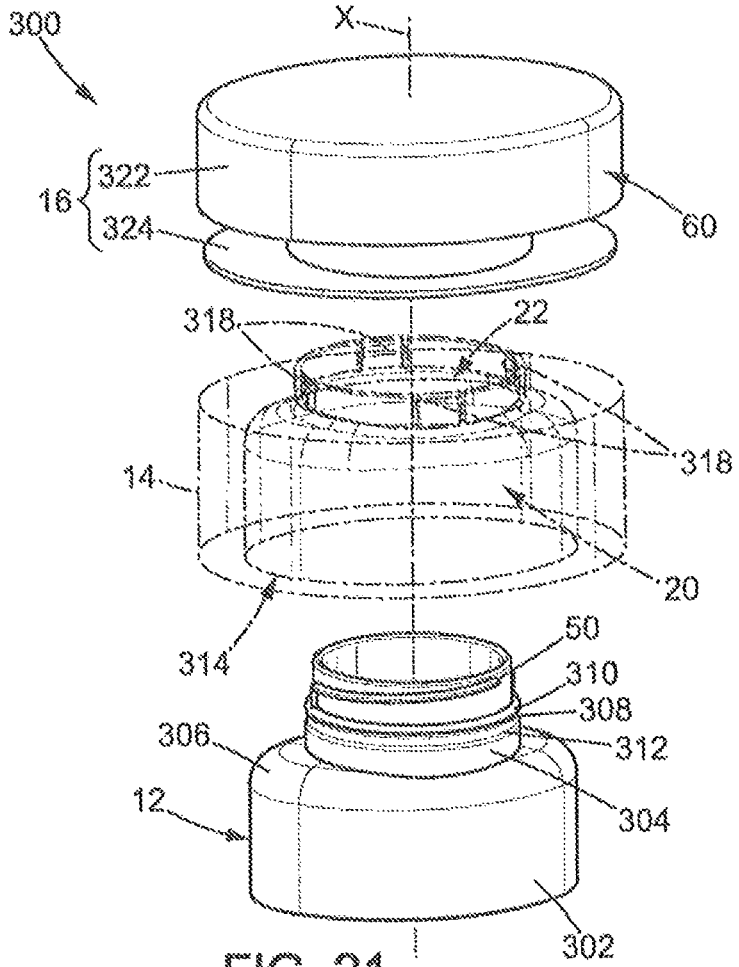
FIG. 21 is an exploded view of a fourth example of a refillable device for packaging cosmetic product.
Figure 22:
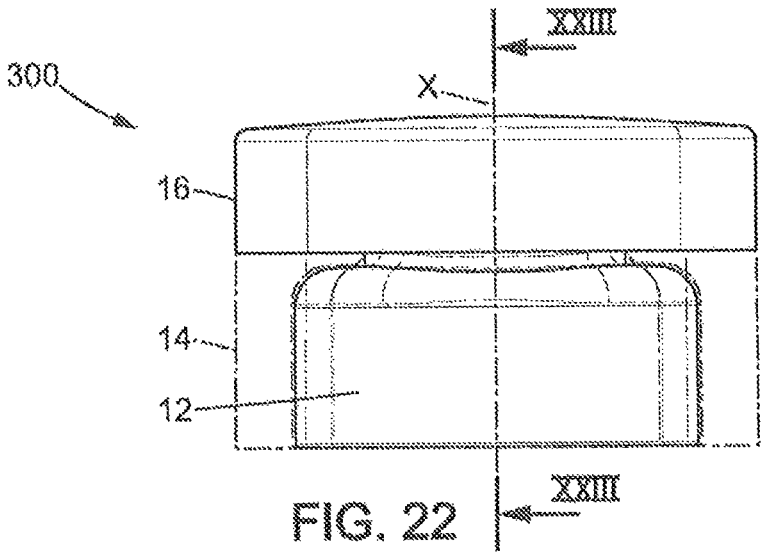
FIG. 22 is a front view of the fourth example of a refillable device for packaging cosmetic product.
Figure 23:
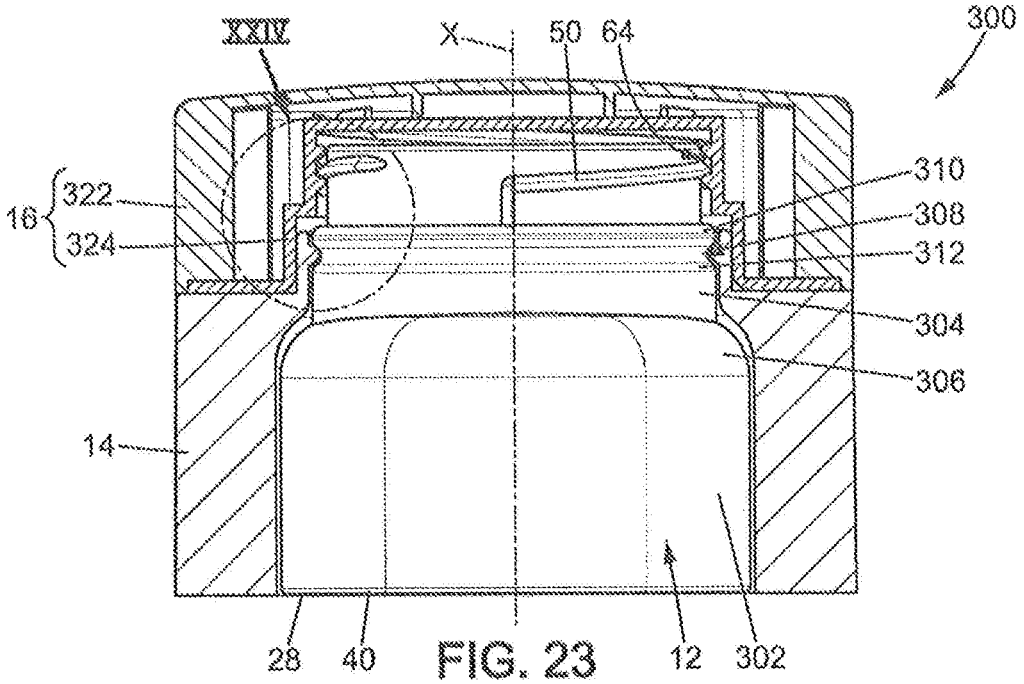
FIG. 23 is a partial cutaway view, along plane XXIII, of the fourth example of a refillable device for packaging cosmetic product.
Figure 24:
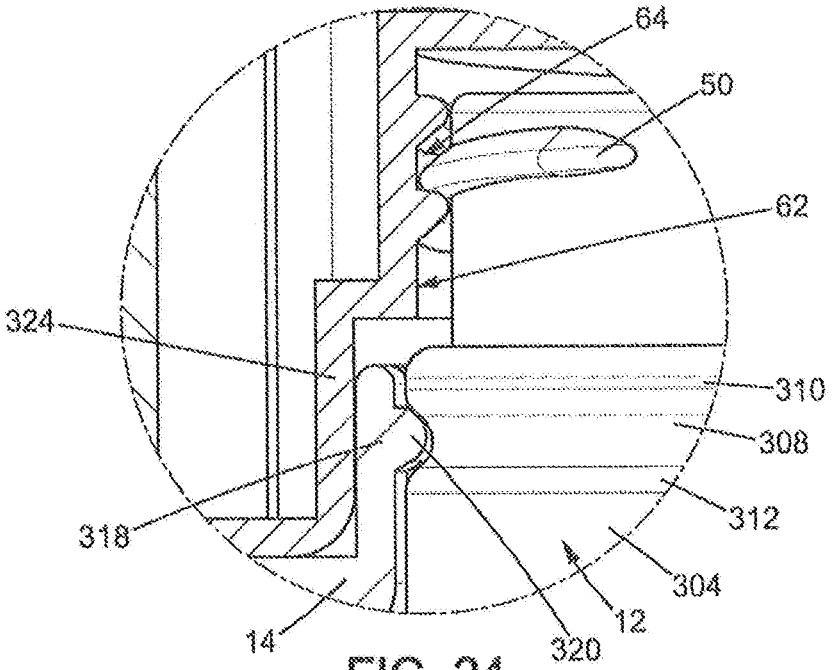
FIG. 24 shows details XXIV of FIG. 23.

The removable container 12 is then inserted into the housing 20 formed by the outer casing 14 as illustrated in FIG. 15. As can be seen in FIG. 15, in this position the beads 222 of the tabs 220 formed by the ferrule 202 are not yet received in the groove 226 formed on the radially outer surface of the side wall 44 of the removable container 12. In this position, the tabs 220 are elastically deformed.

The removable container 12 is then pushed to allow the removable container 12 to be elastically interlocked on the ferrule 202. In other words, the removable container 12 is pushed in such a way that the beads 222 of the tabs 220 formed on the ferrule 202 are received in the groove 226 on the side wall 44 of the removable container 12. At the same time, the half-disk shaped reliefs 218 of the radially inner face of the second collar 206 of the ferrule 202 are received in the complementary housings 224 formed in the side wall 44 of the removable container 12. As a result, relative rotation of the removable container 12 with respect to the ferrule 202 is restricted or even prevented. It is also possible to allow indexation of the removable container 12 relative to the ferrule, in particular by implementing different housings 224 and reliefs 218.

Finally, the lid 16 is screwed onto the removable container 12. Since the ferrule 202 is already rotationally integral with the outer casing 14, it is easier to screw the lid 16 onto the removable container 12, while keeping the outer casing 14 immobile.

Once the lid 16 is screwed onto the removable container 12, the elastic interlocking of the tabs 220 on the removable container 12 is locked in place. Indeed, as is particularly visible in FIG. 20, in this position the tabs 220 are sandwiched between the lid 16 and the removable container 12, preferably with limited backlash or no backlash at all. The elastic deformation of the tabs 220 required for disassembly of the removable container 12 is thus prevented.

However, disassembly of the removable container 12 from the outer casing 14 is possible after removal of the lid 16. Preferably, this removal of the removable container 12 from the outer casing 14 is reversible, meaning such that the removable container can be elastically refitted onto an outer casing.

FIGS. 21 to 24 illustrate a fourth example 300 of a packaging device for cosmetic product.

In this fourth example 300, the removable container 12 comprises two portions 302, 304, one of them having larger dimensions than the outlet 22 of the housing 20 in the outer casing 14. More specifically, the removable container 12 comprises a lower portion 302, of greater cross-sectional area than that of the outlet 22 of the housing 20 in the outer casing 14, and an upper portion 304, of substantially the same cross-sectional area as that of the outlet 22 of the housing 20 in the outer casing 14.

The lower portion 302 forms a reservoir for cosmetic product. This lower portion 302 may be of any shape, adapted to the housing 20 in the outer casing 14. The lower portion 302 here forms a shoulder 306 near the upper portion 304. The upper portion 304 of the removable container 12 has substantially the shape of a neck, provided with a circular groove 308 surrounded by two circular beads 310, 312, and an external thread 50 near the outlet of the removable container 12.

To allow insertion of the removable container 12 at least partially into the housing 20 in the outer casing 14, the outer casing 14 is provided with an opening 314, opposite to the outlet 22 of the housing 20 in the outer casing, its cross-section adapted to the cross-section of the lower portion 302 of the removable container 12. This opening 314 is in particular of larger cross-sectional area than the cross-sectional area of the outlet 22.

Around the outlet 22 of the housing 20 in the outer casing 14, the outer casing 14 forms a flange 316 with elastically deformable tabs 318. In the current case, the flange 316 comprises four tabs 318 uniformly distributed angularly around the outlet 22 of the housing 20 in the outer casing 14. The tabs 318 have a bead 320 directed radially inward. The bead 320 has a cross-section substantially complementary to the cross-section of the groove 308 in the upper portion 304 of the removable container 12.

Finally, in the example illustrated, the lid 16 is formed from the assembly of an outer casing 322 and an inner casing 324. The outer casing 322 defines the outer wall 60 of the lid 16, while the inner casing 324 defines the inner wall 62 of the lid 16. In particular, the inner casing 324 defines a thread 64 adapted to engage with the external thread 50 on the removable container 12 to allow the lid 16 to be screwed onto the removable container 12 to attach it.

This fourth exemplary embodiment 300 thus differs from the exemplary embodiments described above in that the removable container 12 is inserted into the outer casing 14 through an opening 314 that is opposite to the outlet 22 of the housing 20 in the outer casing 14, the removable container 12 being attached to the outer casing 14 near said outlet 22. Here, the removable container 12 is attached to the outer casing 14 by elastically fitting the tabs 318 of the outer casing 14 into the groove 308 on the removable container 12. As above, and as is particularly visible in FIG. 24, once the lid 16 is attached to the removable container 12, the tabs 318 of the outer casing are sandwiched between the inner casing 324 of the lid 16 and the removable container 12, restricting or even preventing elastic deformation of the tabs 318. The attachment of the removable container 12 to the outer casing 14 is thus locked. However, removal of the lid 16 allows the tabs 318 to again be elastically deformed, so as to withdraw the 320 beads on these tabs 318 from the groove 308 in the removable container. The removable container 12 is thus released and can then be removed from the outer casing 14, through the opposite opening 314.

In this embodiment, it is possible to implement the lower portion 302 of the removable container 12 in any desired shape, adapted to the housing 20 in the outer casing 14.

It should be noted here that because the removable container 12 is not rotationally symmetrical—the cross-section of the lower portion 302 having an ellipse shape—and the housing 20 being of complementary geometry to the lower portion 302 of the removable container 12—in the current case with a cross-section that also has an ellipse shape—the removable container 12 is prevented from rotating about the X axis, with respect to the outer casing 14. In other words, the removable container 12 and the outer casing 14 are integral in rotation about the axis X. This allows in particular the ability to screw the lid 16 easily on the removable container 12 while holding the outer casing 14, which has the effect of preventing rotation of the removable container about the X axis.

The invention is not limited to the embodiments described above with reference to the figures, but on the contrary is capable of many variants accessible to those skilled in the art. In particular, the features of the various embodiments described may be combined in embodiments not illustrated in the figures.

Moreover, the side wall of the removable container may in particular be of substantially hemi-ellipsoidal shape or even of polyhedral shape.

The bottom 40 of this removable container may not be flat. Preferably, the bottom 40 of the removable container is shaped to cause imbalance of the removable container when the bottom of the removable container is placed on a flat support. The bottom 40 is for example formed by a protruding relief that is not flat. Additionally or alternatively, the bottom of the removable container is created by a face of a protruding relief, which may be flat, such that the line joining the center of the face and the center of gravity of the removable container forms a non-straight angle with the direction of the weight of said removable container, when its bottom is placed on a flat support.

According to another aspect, in the example illustrated in FIGS. 14 to 20, the ferrule 202 is attached on the outer casing 14 by press-fitting. Alternatively, the ferrule 202 may be attached on the outer casing 14 by gluing, welding, or any other means known to those skilled in the art. Preferably, the ferrule 202 is attached on the outer casing 14 in a lasting manner, so that the ferrule 202 remains mounted on the outer casing 14 in case of removal of the removable container 12. In particular, the disassembly of the ferrule 202 from the outer casing 14 may require the use of a tool.

In the examples described, the elastically interlocking reliefs are separate, carried by separate tabs. However, it is conceivable to have an example with a single elastically interlocking relief, respectively on the outer casing and on the removable container, this elastically fitting relief then being able to be discontinuous.

Finally, the lid may be attached to the removable container by screwing, as in the examples described above, or alternatively by elastic interlocking, clamping, magnetization, by means of a bayonet attachment, or by any other means accessible to the skilled person.

It is possible that the lid may be screwed onto the outer casing, which then has an external thread complementary to that of the lid.

The invention claimed is:

1. A refillable device for packaging cosmetic product, comprising:

a removable container containing cosmetic product, comprising a bottom, an orifice and a side wall between the bottom and the orifice, an outer casing defining a housing for receiving the removable container, the housing for receiving the removable container being open at an outlet in the outer casing, the outer casing forming a neck around the outlet, the removable container being attached to the outer casing by an elastic interlocking of complementary reliefs on the side wall of the removable container and the neck of the outer casing, the removable container being reversibly removable from the outer casing, a lid adapted to seal closed the outlet of the housing in the outer casing, the lid comprising a top and a lateral wall extending from the top, wherein the lateral wall of the lid and the top of lid define an open cavity, wherein the lid is adapted to be attached to one among the outer casing and the removable container so that the side wall of the removable container is sandwiched between the side wall of the outer casing and the lateral wall of the lid so as to limit a deformation of the side wall of the removable container to lock in place the elastic interlocking of the complementary reliefs.

2. The device according to claim 1, wherein the lid is adapted to be directly attached to one among the outer casing and the removable container, so as to lock in place the elastic interlocking of the complementary reliefs.

3. The device according to claim 2, wherein the removable container forms an external thread and the lid forms a complementary internal thread so that the lid is directly attached to the removable container by screwing.

4. The device according to claim 1, wherein the removable container is directly attached on the outer casing by the elastic interlocking of complementary reliefs of the removable container and outer casing.

5. The device according to claim 4, wherein the removable container has at least one tongue that is uniformly distributed angularly, and the outer casing has at least one groove adapted to receive beads of the at least one tongue.

6. The device according to claim 4, wherein the removable container forms a rim having a substantially U-shaped cross-section, the rim being adapted to cover an edge of the outer casing around the outlet.

7. The device according to claim 1, wherein the bottom of the removable container is shaped to cause imbalance of the removable container when the bottom of the removable container is placed on a flat support.

8. The device according to claim 7, wherein the bottom is created by a face of a protruding relief, the center of said face being such that the line joining said center with the center of gravity of the removable container forms a non-straight angle with the direction of the weight of said removable container, when the bottom thereof is placed on a flat support.

9. The device according to claim 1, wherein the outer casing has a bottom.

10. The device according to claim 9, wherein the outer casing has a through-hole from the bottom of the outer casing and into the housing receiving the removable container.

11. The device according to claim 1, wherein the lid is adapted to be attached on the removable container by screwing, elastic interlocking, clamping, or by means of a bayonet attachment.

12. The device according to claim 11, wherein the lid has a radially inner wall provided with a thread intended to engage with a complementary thread on the removable container.

13. The device according to claim 1, comprising a gasket of cross-section substantially complementary to the cross-section of the orifice of the removable container, the gasket sealing closed the orifice when the lid is attached to the removable container.

14. The device according to claim 1, comprising a gasket, the gasket extending substantially along the edge of the orifice of the removable container such that the gasket is received in or around the orifice of the removable container when the lid is attached to the removable container.

15. The device according to claim 1, wherein the lid is of one among: wood, a ceramic material, metal, porcelain, rigid foam for example polyurethane, natural stone, synthetic stone, stone powder mixed with a binder, injection-molded, leather, glass, crystal, plastic, natural fabric, or synthetic fabric.

16. The device according to claim 1, wherein at least one among the outer casing and the lid is translucent.

17. The device according to claim 1, wherein the outer casing is of one among: glass, metal, ceramic, porcelain, crystal, and plastic, natural stone, synthetic stone, ceramic, porcelain, wood, and urea-formaldehyde.

18. The device according to claim 1, wherein the removable container is attached to the outer casing by means of a ferrule, the ferrule being directly attached to the outer casing, the removable container elastically interlocked on the ferrule by the engagement of complementary reliefs of the ferrule and removable container, and wherein the ferrule is of one among the following materials: plastic, or metal.

19. A refillable device for packaging cosmetic product, comprising:

a removable container containing cosmetic product, an outer casing defining a housing for receiving the removable container, the housing for receiving the removable container being open at an outlet in the outer casing, the outer casing having a lateral wall and a bottom, the lateral wall and the bottom of the outer casing defining the housing, the removable container being attached to the outer casing by an elastic interlocking of complementary reliefs, the removable container being reversibly removable from the outer casing, a lid adapted to seal closed the outlet of the housing in the outer casing, wherein the lid is adapted to be attached to one among the outer casing and the removable container so as to lock in place the elastic interlocking of the complementary reliefs, wherein the outer casing has an opening extending through the bottom of the outer casing, the opening being of dimensions that allows insertion of the removable container through the opening into the housing in the outer casing.

20. A method for replacing a removable container in a refillable device for packaging cosmetic product, the refillable device comprising:

a removable container containing cosmetic product, comprising a bottom, an orifice and a side wall between the bottom and the orifice, an outer casing defining a housing for receiving the removable container, the housing for receiving the removable container being open at an outlet in the outer casing, the outer casing forming a neck around the outlet, the removable container being attached to the outer casing by an elastic interlocking of complementary reliefs on the side wall of the removable container and the neck of the outer casing, the removable container being reversibly removable from the outer casing, a lid adapted to seal closed the outlet of the housing in the outer casing, the lid comprising a top and a lateral wall extending from the top, wherein the lateral wall of the lid and the top of lid define an open cavity, wherein the lid is adapted to be attached to one among the outer casing and the removable container so that the side wall of the removable container is sandwiched between the side wall of the outer casing and the lateral wall of the lid so as to limit a deformation of the side wall of the side wall of the removable container to lock in place the elastic interlocking of the complementary reliefs, the method comprising the steps of:

detaching the lid from the refillable device;

removing the removable container from the refillable device;

providing a new removable container;

attaching the removable container in the outer casing by fitting together the elastically interlocking complementary reliefs; and attaching the lid of the refillable device or a new lid, directly on the removable container or on the outer casing, this attachment of the lid on the removable container locking in place the elastic interlocking of the elastically interlocking complementary relief.

* * * * *